US006957881B2

(12) United States Patent
Nishino

(10) Patent No.: US 6,957,881 B2
(45) Date of Patent: Oct. 25, 2005

(54) INKJET PRINTER

(75) Inventor: Satoshi Nishino, Sayama (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/033,424

(22) Filed: Jan. 11, 2005

(65) Prior Publication Data

US 2005/0156995 A1 Jul. 21, 2005

(30) Foreign Application Priority Data

Jan. 20, 2004 (JP) ..... 2004-012263
Jan. 20, 2004 (JP) ..... 2004-012294
Jan. 20, 2004 (JP) ..... 2004-012305

(51) Int. Cl.[7] ..... B41J 2/165
(52) U.S. Cl. ..... 347/33; 347/29; 347/32
(58) Field of Search ..... 347/22, 29, 33, 347/32

(56) References Cited

U.S. PATENT DOCUMENTS 4,223,322 A 9/1980 van Raamsdonk
4,369,456 A 1/1983 Cruz-Uribe et al.
4,935,753 A 6/1990 Lehmann et al.
5,239,316 A 8/1993 Demarchi et al.
5,534,898 A 7/1996 Kashino et al.
5,606,354 A * 2/1997 Bekki et al. ..... 347/33
5,914,734 A 6/1999 Rotering et al.
6,644,776 B1 11/2003 Barinaga et al.

FOREIGN PATENT DOCUMENTS

JP 2705956 B2 10/1997
JP 2001-310454 A 11/2001

* cited by examiner

*Primary Examiner*—Shih-Wen Hsieh
(74) *Attorney, Agent, or Firm*—Frishauf, Holtz, Goodman & Chick, P.C.

(57) ABSTRACT

An inkjet printer comprises a recording head having a plurality of nozzles for jetting ink, and an ink wiping device for wiping ink adhered on a surface of a nozzle of the plurality of nozzles, the ink wiping device including an ink absorber for absorbing ink, a moving device for moving the ink absorber and a pressing member to press a surface of the ink absorber toward the surface of the plurality of nozzles, wherein, the pressing member moves along the surface of the plurality of nozzles.

23 Claims, 11 Drawing Sheets

FIG. 11
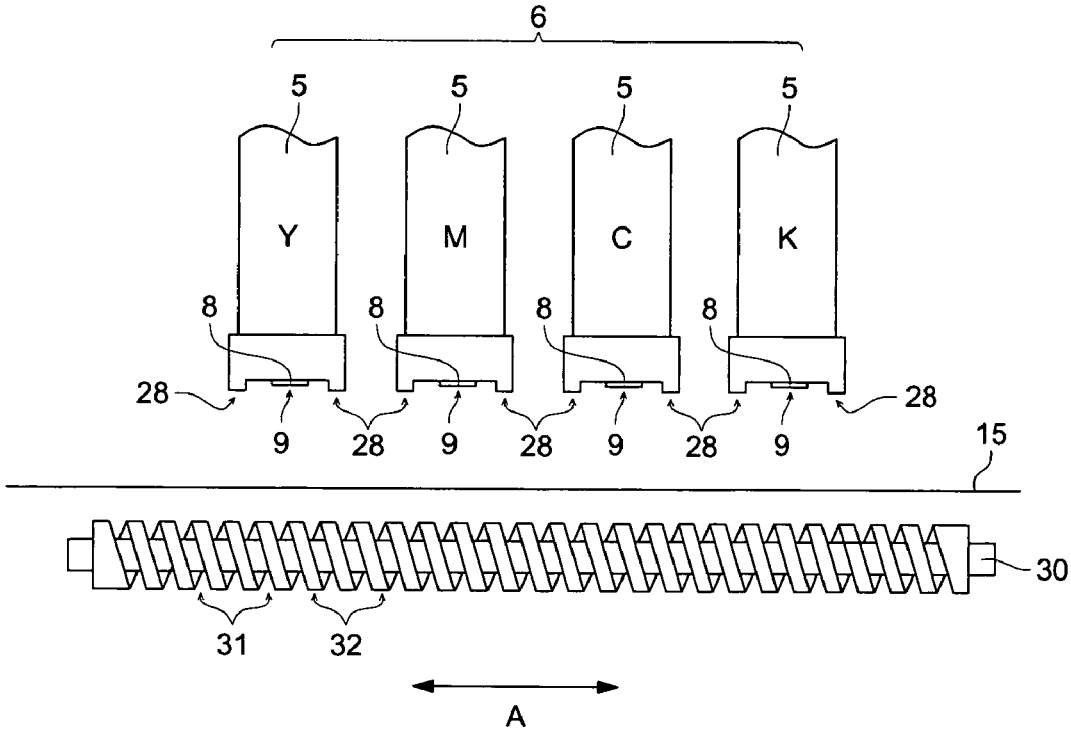
FIG. 12 ( a )
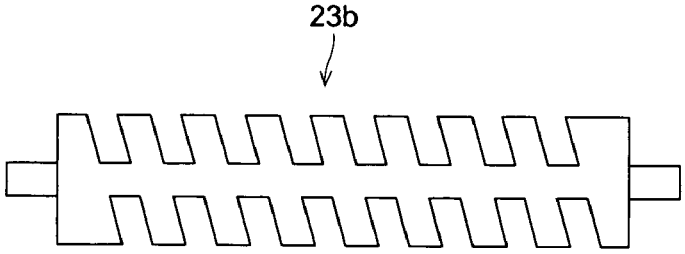
FIG. 12 ( b )
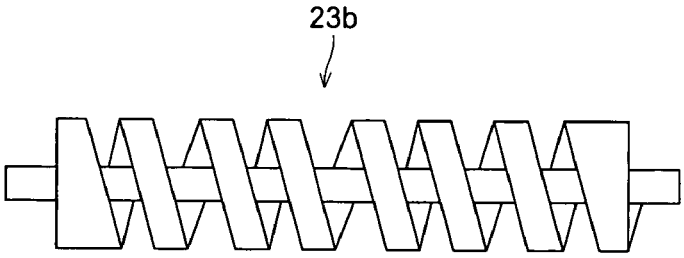

INKJET PRINTER

FIELD OF THE INVENTION

The present invention relates to an inkjet printer, particularly to an inkjet printer for which ink being hardened by irradiating the ultraviolet ray is used.

BACKGROUND OF THE INVENTION

Conventionally, as an image recording device by which an image can be simply recorded at low cast, a lot of image printers employing an inkjet printer system are used. The image printer (hereinafter, called "inkjet printer") employing the inkjet system is a printer in which, for example, a piezoelectric element such as a piezo element or a heater is used and ink is jetted as a very small liquid drop from a nozzle of a recording head onto a recording medium such as a paper sheet. Image recording is conducted by moving a recording head while the ink is penetrated into or fixed onto the recording medium.

Furthermore, recent years, an ultraviolet ray hardening type inkjet printer becomes well known as a printing device by which an image can be formed on the recording medium such as a resin film into which ink poorly absorbed (for example, refer to Patent Document 1). This is a printer in which, when the ultraviolet hardening ink including a light initiator having a predetermined sensitivity for ultraviolet rays is used, the ultraviolet ray is irradiated onto the ink jetted onto the recording medium. The ink is hardened and fixed onto the recording medium. It is also possible to print an image onto a transparent or opaque packing material.

However, in such an inkjet printer, when the recording operation is continuously conducted, there is a possibility that ink jetted from the nozzle of the recording head and turned into fog is adhered to and accumulated in the vicinity of the nozzle and causes clogging. Particularly, in the ultraviolet ray hardening type inkjet printer, there is a case that the ink adhered to the vicinity of the nozzle is hardened by reflected rays of an ultraviolet ray source. When an printing operation is conducted under such a condition, even when the nozzle conducts the jetting operation by the operation of piezo elements, an jet failure so-called nozzle-absence by which ink-droplets are not jetted, or the jetting-curvature by which the ink-droplets are not jetted in the right direction is caused, which results in failure in an image recording.

Accordingly, in order to conduct a normal image recording, it is necessary to appropriately conduct a cleaning operation of a recording head. With regard to the cleaning operation of the recording head, known is an operation by which an ink absorber of a sheet member such as a paper sheet is brought into contact with the recording head and the ink adhered to the vicinity of the nozzle of the recording head is absorbed and removed (for example, refer to Patent Document 2).

(Patent Document 1) Japanese Patent Application open to Public, Tokkai 2001-310454

(Patent Document 2) Japanese Patent 2705956

However, in the case of the above Patent Document 2, when the undulation is formed on the nozzle surface of the recording head, or the nozzle is projected to the recording head, the ink absorber can not correspond to the undulation of the nozzle surface, and the ink adhered to the vicinity of the nozzle can not be adequately brought into close contact with the ink absorber and absorbed. Particularly, in the industrial inkjet printer having a plurality of nozzles, it is difficult that the nozzle surface is adequately brought into close contact with the ink absorber, and there is a problem that the ink adhered to the vicinity of the nozzle can not be absorbed and remained on the nozzle surface as it is. Further, when the ink, including ultraviolet ray hardening type ink, in which the viscosity is high and wet-property is poor, such as oil series or solvent series is used, the absorption efficiency of the ink further becomes poor, and the cleaning can not be conducted enough. It has a problem that failure may be caused in the image recording.

SUMMARY OF THE INVENTION

An object of the present invention is to provide an inkjet printer in which a cleaning operation by which the ink is adequately absorbed in the ink absorber and the ink adhered to the nozzle surface is surely removed can be conducted, and a very fine image recording is conducted.

In accordance with one aspect of the present invention, an inkjet printer comprises a recording head having a plurality of nozzles for jetting ink, and an ink wiping device for wiping ink adhered on a surface of a nozzle of the plurality of nozzles, the ink wiping device including an ink absorber for absorbing ink, a moving device for moving the ink absorber and a pressing member to press a surface of the ink absorber toward the surface of the plurality of nozzles, wherein, the pressing member moves along the surface of the plurality of nozzles.

BRIEF DESCRIPTION OF THE DRAWING

FIG. 11 is a front view showing a part of the ink-wiping device and the recording head shown in FIG. 2.

FIG. 12(*a*) is a front view of a spiral pressing member, and FIG. 12(*b*) is a front view of the spiral pressing member in which the intervals of the spiral are alternatively made narrow and broad one.

DETAILED DESCRIPTION OF THE INVENTION

Figure 1:
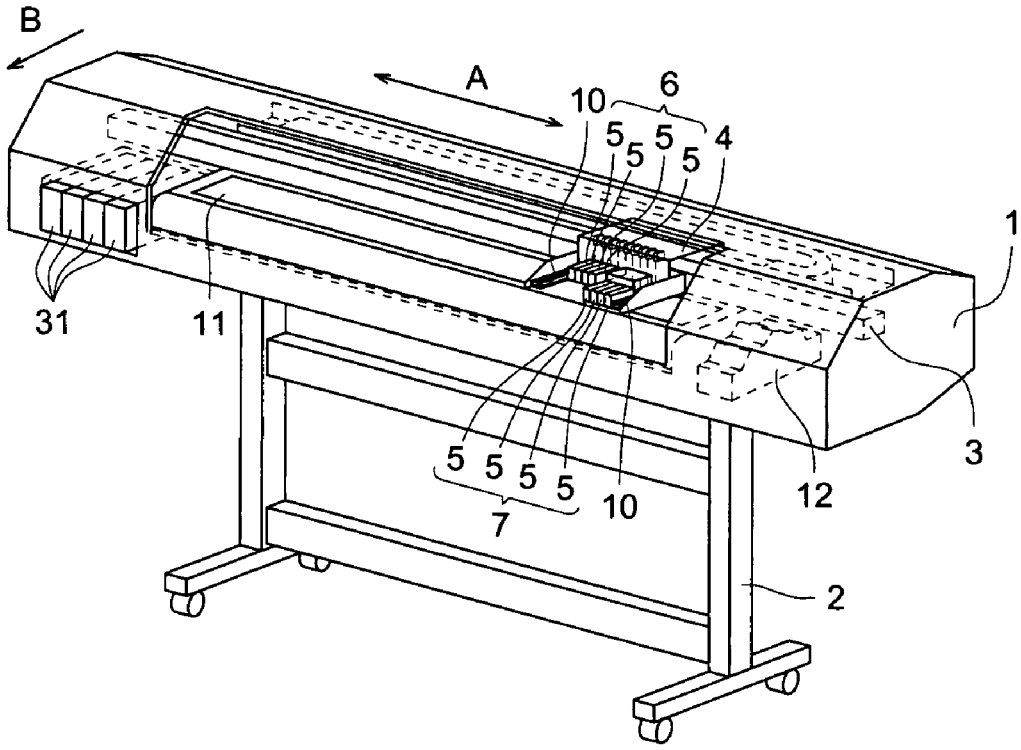
FIG. 1 is a perspective view showing an embodiment of an inkjet printer according to the present invention.

Referring to FIG. 1 to FIG. 8, a specific embodiment of the present invention will be described below. However, a scope of the invention is not limited to an example shown in the drawing, and it is of course that various changes can be added in the scope which does not depart from the spirit of the present invention.

FIG. 1 shows an embodiment of the inkjet printer according to the present invention, and the inkjet printer by the present embodiment is a serial head system inkjet printer, and provides with a printer main body 1 and a support table 2 supporting the printer main body 1.

In the inside of the printer main body 1, a bar-like guide rail 3 is provided and on this guide rail 3, a carriage 4 is supported. Carriage 4 is reciprocally moved along the guide rail 3 in a main scanning direction A which is a width direction of a recording medium P by a carriage driving device (not shown).

Further, on carriage 4, a recording head 5 jetting each of colors of yellow (Y), magenta (M), cyan (C) and black (K) is mounted. Recording head 5 respectively structures head units 6 and 7 by 4 recording heads 5 of each of colors of yellow (Y), magenta (M), cyan (C) and black (K). In the present embodiment, 2 head units 6 and 7 are arranged in sub scanning direction B by shifting their positions.

Further, on recording head 5, a plurality of nozzles 8 (refer to FIG. 5) jetting the ink are arranged in sub scanning direction B and a surface facing to the recording medium P (not shown) on which nozzle 8 of recording head 5 is formed, is defined here as a nozzle surface 9.

Herein, the ink used in the present embodiment will be described. When the ink is hardened, polymerization compounds included in the ink are polymerization-reacted. In the present embodiment, the ink contains an activation energy ray hardening compound as the polymerization compound. And as for the ink, ultraviolet ray hardening ink is employed for starting the polimerization reaction which uses ultraviolet ray as the activation energy.

The ultraviolet ray hardening ink is largely divided into the radical hardening ink including the radical polymerization compound and the cation hardening ink including the cation polymerization compound as the polymerization compound, and both of them are applicable as the ink used in the present embodiment, and the hybrid type ink into which the radical hardening ink and the cation hardening ink are compounded, may also be applied as the ink used in the present embodiment.

However, since the cation hardening ink in which an interference of the polymerization reaction by oxygen is small or does not exist, is excellent in functionality and wide usability, the cation hardening ink is used in the present embodiment. The cation hardening ink used in the present embodiment is a mixture including at least the cation polymerization compound such as oxetane compound, epoxy compound, vinyl ether compound, ray cation initiator and color materials. It also has a nature being hardened by the irradiation of the above-described ultraviolet ray.

Further, the ink in the present embodiment is a liquid having a viscosity of 10–50 [mPa·s] at 23° C. and surface tension of 20–40 [mN/m]. The ink has a high viscosity and poor wettability.

Further, on both sides in the main scanning direction A of recording head 5 of carriage 4, ultraviolet ray irradiation device 10 which irradiates ultraviolet ray onto the ink jetted from nozzle 8 onto recording medium P and hardens the ink is provided.

One area of the movable range of carriage 4 is a recording area on the recording medium P, and under carriage 4 in this recording area, platen 11 being a plate member and supporting the recording medium P from the recorded surface is arranged.

Further, on one end of the outside of the recording area which is the movable range of carriage 4, a maintenance unit(not shown) to conduct cleaning of nozzle 8 of recording head 5 is provided. Herein, in the inkjet printer of the present embodiment, when number of times of image recording reaches at a predetermined number, carriage 4 is moved to a predetermined position of the maintenance unit and cleaning is conducted.

Normally, in the maintenance unit, when carriage 4 is moved to the maintenance unit, an ink suction device (not shown) to suck the ink from nozzle 8 of recording head 5 and an ink wiping device 12 (refer to FIG. 2) to wipe the ink remained on nozzle surface 9 are provided at the position opposed to recording head 5. In the present embodiment, after ink wiping device 12 wipes off the ink remained on nozzle surface 9, when the ink is inanely jetted to form a meniscus, ink wiping device 12 is also used for a inanity jet receiving tray to receive the jetted ink.

Figure 2:
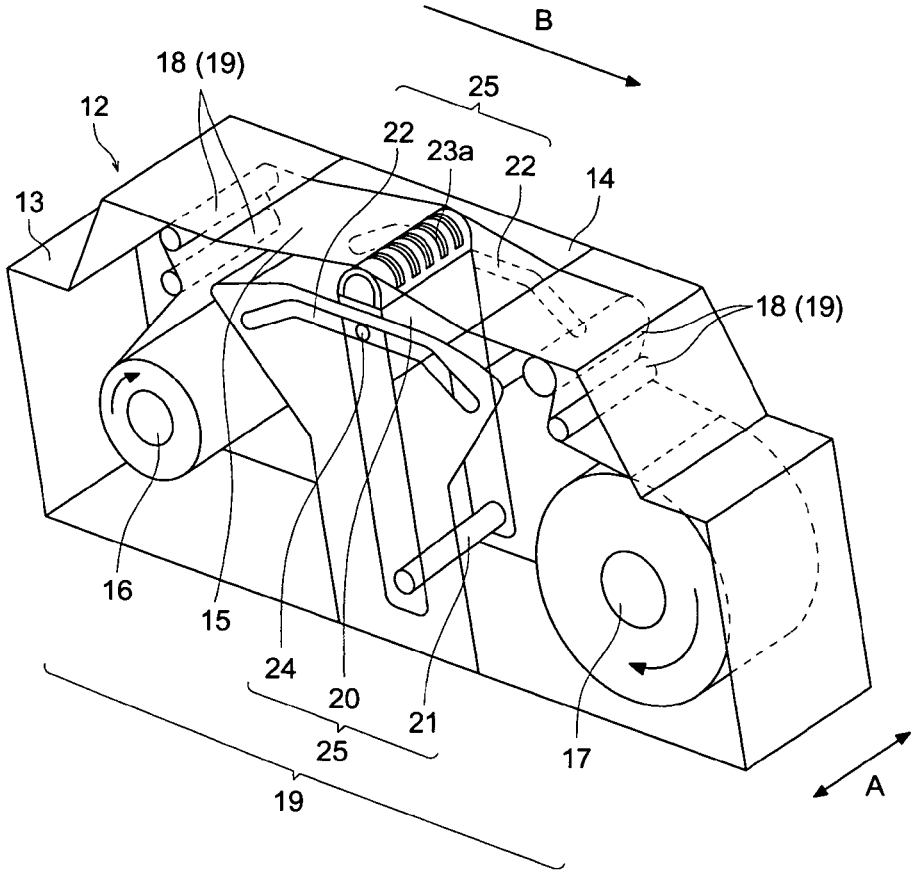
FIG. 2 is a perspective view of an ink-wiping device in the inkjet printer shown in FIG. 1.

Ink wiping device 12 has a polygonal box type member 13 as shown in FIG. 2, and at the center of the upper surface of box type member 13, opening portion 14 is formed.

On both ends of sub scanning direction B which are inside box type member 13, a sending-out shaft 16 to send out ink absorber 15 and winding-up shaft 17 which is rotated by a roller shaft driving device (not shown) and winds up ink absorber 15 are respectively arranged. On sending-out shaft 16, a lengthy ink absorber 15 is wound up. A part of ink absorber 15 is guided by a plurality of guide rollers 18 so as to be exposed from the opening portion 14 and wound up on the winding-up shaft 17. Ink absorber 15 exposed from the opening portion 14 faces to nozzle surface 9 of recording head 5. Sending-out shaft 16, winding-up shaft 17, guide roller 18 and roller shaft driving device structure ink absorber moving device 19.

Further, the width of ink absorber 15 is designed to cover the whole nozzle surface 9 of a plurality of recording heads 5 having at least each of head units 6 and 7, that is, in the present embodiment, it covers all nozzle surfaces of the main scanning direction A in each of head units 6 and 7.

Ink absorber 15 is formed by high density fiber which is very fine fiber of about 0.1 denial. The high density fiber is formed by material of one of polyester, acrylic resin, nylon, or any combination of them. In this manner, ink absorber 15 is formed by high density fiber to easily attract materials which comes into contact with its surface. It quickly absorbs the ink adhered to nozzle surface 9 of recording head 5 irrespective of the viscosity or wetting property of the ink. That is, ink absorber 15 in the present embodiment, even when the ink has the higher viscosity and poorer wetting property than the that of ordinarily ink including, for example, ultraviolet ray hardening ink, such as oil or solvent series, it can surely absorb the ink adhered to nozzle surface 9.

EXAMPLE 1

Next, example 1 of the present invention will be described.

Figure 3:
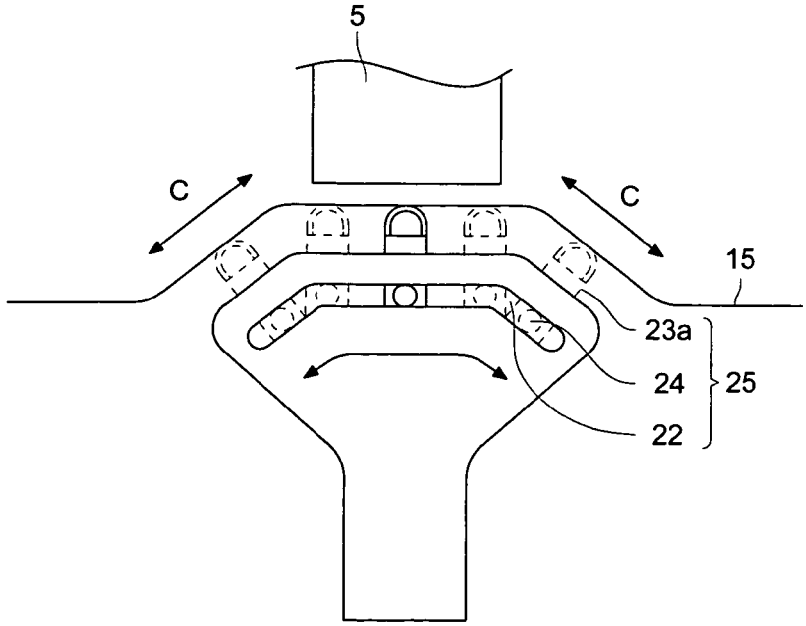
FIG. 3 is a front view showing a part of the ink-wiping device expressing an operation of a pressing member.

A support table 20 is provided between the sending-out shaft 16 and the winding-up shaft 17, and which is deposited below ink absorber 15. A support shaft 21 rotatably supported on the both side surfaces of box type member 13 is affixed to both-end sides of the lower end portion of support table 20. Above both side surfaces of box type member 13, as shown in FIG. 3, the central portion corresponding to recording head 5 is extended in the horizontal direction so that it is substantially parallel with nozzle surface 9 of recording head 5. A guide hole 22 having the shape, in which both end portions are bent lower, is formed. Hereupon, both end portions of the guide hole 22 is used as a stand-by position C when ink wiping device 12 is not operated or when the ink wiping device is operated and carriage 4 is moved. Stand-by position C is the area to which a pressing member 23*a*, which will be described later, is evacuated when carriage 4 is moved, so that a leading edge of the recording head is not directly brought into contact with pressing member 23*a*.

Further, pressing member 23*a* is affixed to the upper end portion of supporting table 20 so that it moves up and down. Guide shaft 24 engaged with guide hole 22 is affixed on an upper position of the both sides of pressing member 23*a*. Then, when supporting table 20 is rocked by a supporting table driving device (not shown), pressing member 23*a* is rocked following the rocking movement of supporting table 20. As guide shaft 24 of pressing member 23*a* is guided along guide hole 22 and while pressing member 23*a* is moved up and down against supporting table 20, pressing member 23*a* is moved on the rear surface of ink absorber 15 along sub scanning direction B. Hereupon, in the present embodiment, supporting table moving device 25 is structured by support table 20, support shaft 21, guide hole 22, guide shaft 24, and supporting table driving device.

Figure 4:
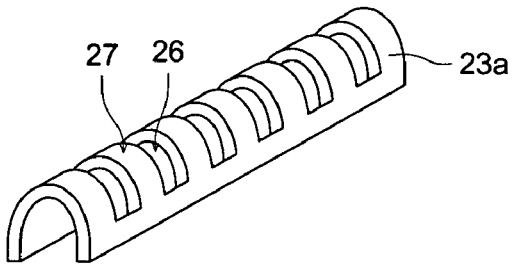
FIG. 4 is a perspective view of an arctic pressing member.
Figure 5:
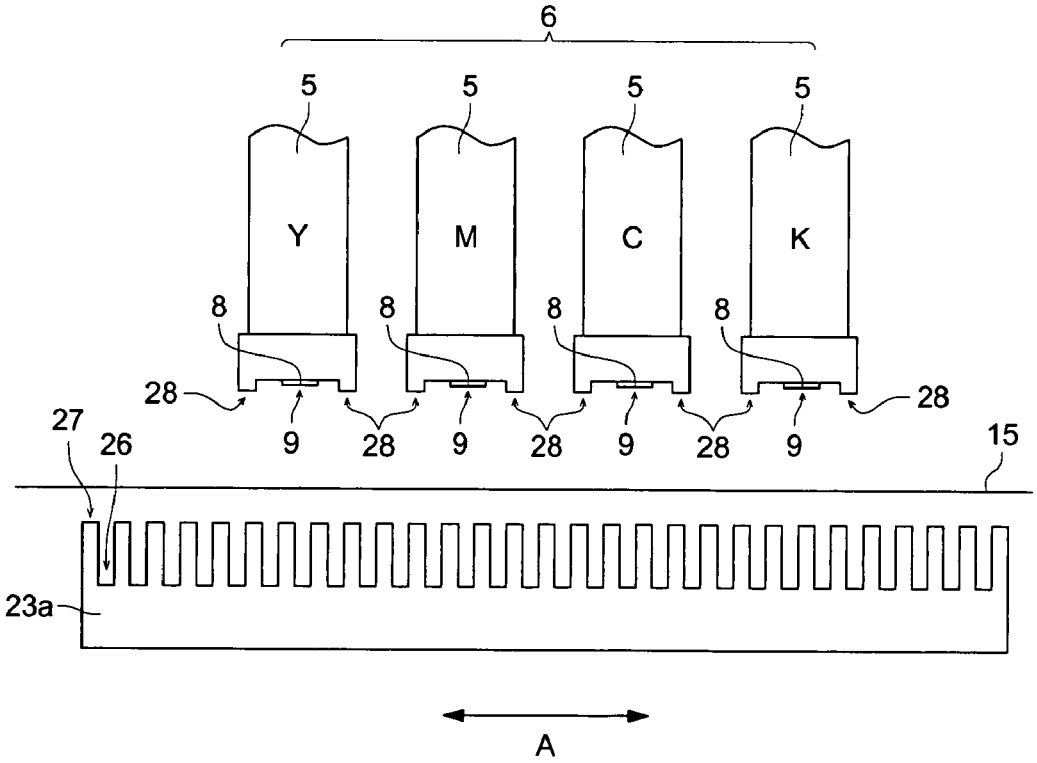
FIG. 5 is a front view showing a part of the ink-wiping device shown in FIG. 2.

In the present embodiment, pressing member 23*a* is, as shown in FIGS. 4 and 5, formed in such a manner that the sectional shape is arc-like, by bending a thin board member, and a plurality of slits 26 are formed with a predetermined interval in the width direction on pressing member 23*a*. An area between each slits 26 of pressing member 23*a* is a contact portion 27.

As shown in FIG. 5, on both side edges of nozzle surface 9 of recording head 5 of the present embodiment, convex portion 28 to protect nozzle 8 is formed. In the present embodiment, slits 26 of pressing member 23*a* are formed in such a manner that they correspond to the interval of the convex portion 28 of recording head 5. When pressing member 23*a* is brought into contact with nozzle surface 9 of recording head 5 through ink absorber 15, this mechanism is formed in such a manner that the slit 26 positions at the convex portion 28 of the recording head and the contact portion 27 can be brought into contact with nozzle surface 9 of recording head 5, and ink absorber 15 can be brought into close contact with nozzle surface 9. Further, since pressing member 23*a* is formed of the thin board member, the contact portion 27 has a elastic force, and as the result even when the contact portion 27 comes into contact with the convex portion 28, the contact portion 27 is deflected and the contact portion 27 corresponding to nozzle surface 9 can be adequately brought into contact with nozzle surface 9. Hereupon, it is rather preferable that, in the contact portion 27 and slit 26, since ink absorber 15 can be more easily brought into close contact with nozzle surface 9, they are respectively formed in such a manner that their width dimensions are small and the number of them is large.

Further, pressing member 23*a* is formed in such a manner that its thickness is 0.2–2.0 mm. When the thickness of the thin board member is not more than 0.2 mm, it is difficult to practically form it. Particularly when the thickness is more than 2.0 mm, even when the slit 26 is provided, because of the characteristic of the material, the elastic effect to deflect the contact portion 27 cannot be obtained.

Hereupon, the width dimension of pressing member 23*a* is formed in such a manner that it is the length at least equal to the width dimension of ink absorber 15 or more than that.

Further, pressing member 23*a* is formed of any one material of polyethylene, 4-fluoride ethylene, 4, 6-fluoride propylene. Pressing member 23*a* using such a material can use for a long period of times, when it is brought into contact with nozzle surface 9 even when the ink including for example, organic solvent like a ultraviolet ray hardening ink of cation series is adhered, without being swelled and/or solved.

Pressing member 23*a* is formed in such a manner that ink absorber 15 can be uniformly pressed to a plurality of nozzle surfaces 9 of recording head 5 with appropriate pressure. When the support table 20 is swung and pressing member 23*a* is caused to reciprocally move one time in the sub scanning direction B, ink absorber 15 can be brought into contact with over the entire range of nozzle surface 9 by pressing member 23*a*.

Other than that, on the other end of the outside of the recording area which is the movable range of carriage 4, an ink tank 29 to supply each color of ink to carriage 4 is provided.

Further, as recording medium P which can be used in the present embodiment, plain paper, recycled paper, glossy paper, media formed of materials such as cloth, non-woven cloth, resin, metal, glass are applicable. Further, as forms of the recording medium P, roll sheets, cut sheets and plane sheets are applicable.

Furthermore, as the recording medium P used in the present embodiment, opaque publicly known recording medium such as paper whose surface is coated by resins, film including pigments and forming film are also applicable.

Next, a mode of operation of the present embodiment will be described.

When a predetermined image information is sent to the inkjet printer and the recording medium P is conveyed to a predetermined position of carriage 4 in the image recording area, carriage 4 is reciprocally moved just above the recording medium P along the guide rail 3.

Then, while carriage 4 is moved, recording head 5 is moved based on the image information, the ink is jetted from each of nozzles 8 onto recording medium P, the ultraviolet ray is irradiated from ultraviolet ray irradiation device 10 onto the recording medium P and the ink is hardened. At this time, by the ultraviolet ray irradiated from ultraviolet ray irradiation device 10 positioned at the downstream of recording head 5 constituting each head unit 6 and 7 in the movement direction of carriage 4, the ink jetted from recording head 5 constituting each head unit 6 and 7 is quickly hardened and fixed onto the recording medium P.

After that, when the inkjet printer repeats the above-described each operation, the image is formed on the recording medium P.

Then, when a predetermined cycle of the image recording is conducted, carriage 4 is moved to a predetermined position of the maintenance unit, and the cleaning is conducted.

Specifically, carriage 4 is moved to the ink suction device, the ink suction device is operated, and the ink remained in nozzle 8 is sucked. After that, carriage 4 is moved to a place where ink wiping device 12 is located, then ink wiping device 12 is operated. The ink adhered to nozzle surface 9 is absorbed by ink absorber 15.

Figure 6:
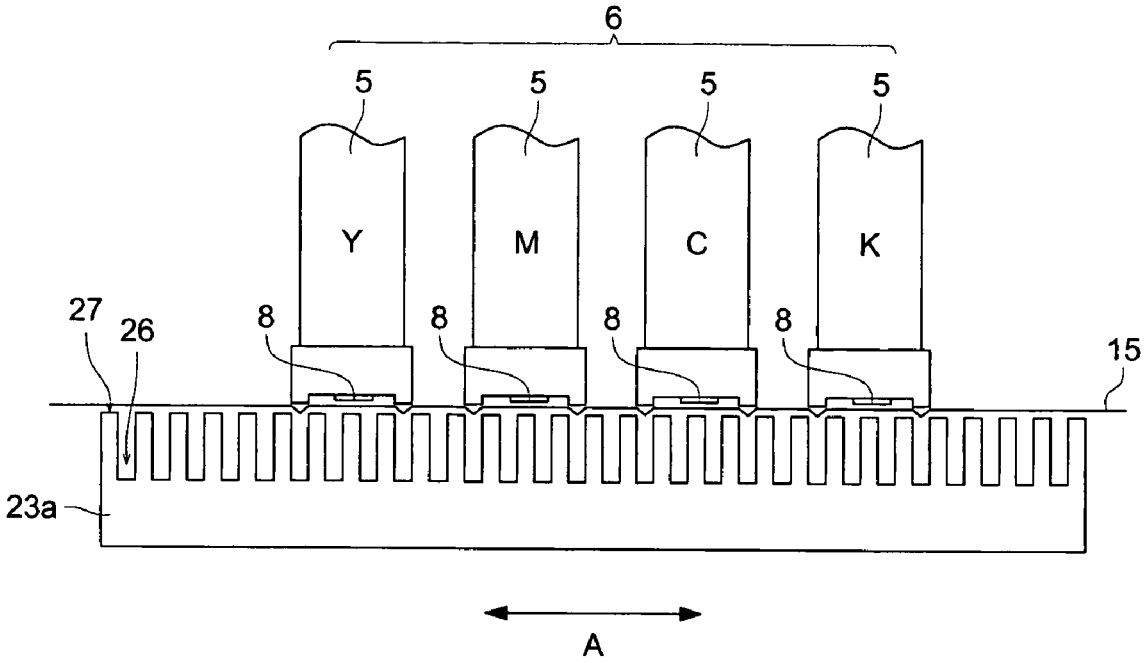
FIG. 6 is a front view showing a part of the ink-wiping device when the pressing member brings an ink absorber into contact with a nozzle surface.

That is, when nozzle surface 9 of recording head 5 constituting the head unit 6 is moved to a position opposing to ink absorber 15, as shown in FIG. 3, the support table moving device 25 is operated and pressing member 23*a* is moved along the guide hole 22 from the stand-by position C. Then, in the position in which nozzle surface 9 of recording head 5 opposes to pressing member 23*a*, as shown in FIG. 6. Ink absorber 15 becomes a condition in which it is brought into close contact with one end portion of nozzle surface 9 through pressing member 23*a*. In this manner, when pressing member 23*a* is reciprocally moved along the guide hole 22 in the position in which recording head 5 is opposed to nozzle surface 9, the ink adhered to nozzle surface 9 is sucked by ink absorber 15. In this case, since this system is formed in such a manner that slit 26 of pressing member 23*a* corresponds to the interval of the convex portion 28 of recording head 5, the slit 26 is positioned in the convex portion 28 of recording head 5, the contact portion 27 can be adequately brought into contact with nozzle surface 9 of recording head 5, and ink absorber 15 can be brought into close contact with nozzle surface 9. Further, because the contact portion 27 of pressing member 23*a* has an elastic force, even when the contact portion 27 comes into contact with the convex portion 28 of recording head 5, the contact portion 27 is deflected, and ink absorber 15 can be adequately brought into close contact with nozzle surface 9 through the contact portion 27 corresponding to nozzle surface 9.

Further, since pressing member 23*a* has elasticity, there is no case where it is brought into contact with nozzle surface 9 with a force larger than required one, and a damage of nozzle 8 or nozzle surface 9 can be prevented.

After that, under the condition that pressing member 23*a* is positioned at stand-by position C, ink absorber 15 and nozzle surface 9 of recording head 5 are separated. Under this condition, the roll shaft driving device is operated, ink absorber 15 is wound up around the wind-up shaft 17 and the ink not-absorbed portion of ink absorber 15 is exposed from the opening portion 14.

Successively, carriage 4 is moved to the position of ink absorber 15 by a distance corresponding to the width of the head unit 6, and the cleaning operation is conducted on the head unit 7 by the above-described ink-wiping device 12. In this manner, By sequentially conducting the operations of movement of pressing member 23*a*, movement of ink absorber 15 and movement of carriage 4 for each of head units 6 and 7, a series of cleaning operations in ink wiping device 12 is completed, and the ink of nozzle surface 9 is assuredly removed.

After that, the ink is inertly jetted to ink absorber 15, and a meniscus is formed. Then, under the condition that pressing member 23*a* is positioned at the stand-by position C, ink absorber 15 and nozzle surface 9 of recording head 5 are separated, further under this condition, the roll shaft driving device is operated. Then, ink absorber 15 is wound up around the wind-up shaft 17 and the ink not-absorbed portion of ink absorber 15 is exposed from the opening section 14.

In this manner, when a series of cleanings in the maintenance unit are completed, carriage 4 returns again to the recording area and the image recording is restarted.

As described above, in the inkjet printer in the present embodiment, when pressing member 23*a* having slits 26 is moved in close contact with nozzle surface 9 through ink absorber 15, even in the ink having high viscosity and poor wettabily, the ink of nozzle surface 9 is absorbed in ink absorber 15, and the ink adhered to the vicinity of nozzle 8 can be assuredly removed. As the result, a very fine image can be obtained without bad influence of the ink adhered to nozzle surface 9 of recording head 5.

Further, since the inert jet can be conducted on ink absorber 15, it is not necessary to provide a receiving tray to conduct the inert jet, and parts necessary for it can be reduced, which results in downsizing and cost reduction of the inkjet printer.

Figure 7:
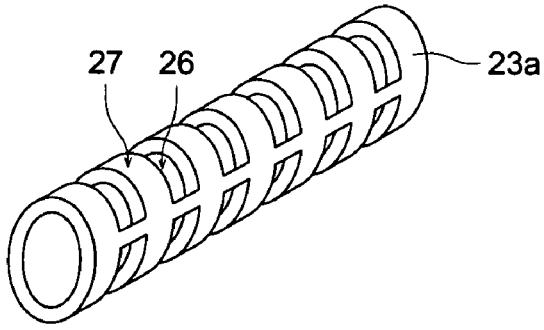
FIG. 7 is a perspective view of a cylindrical pressing member.

As described above, in the present embodiment as shown in FIG. 4, an example in which the pressing member whose sectional shape is arc-like is employed as pressing member 23*a*, is described, it may also be provided in such a manner that a cylindrical pressing member 23*a* rotatably supported on the support table by a support strip as shown in FIG. 7 may be employed. In this case, by forming a plurality of slits as described in the example of the present invention, the same effects can be obtained.

Further, in the present embodiment, cleaning is conducted for each of head units 6 and 7 by pressing ink absorber 15 with one pressing member 23*a* having a length covering the whole of nozzle surfaces 9 of the head units 6 and 7 in the main scanning direction A. However, when a plurality of pressing members 23*a* having a length corresponding to nozzle surface 9 for each of recording heads 5 is provided, ink absorber 15 may also be brought into close contact with nozzle surface 9 of each of recording heads 5.

Further, in the present embodiment, a serial system recording head 5 is used. However, it is also applicable to a line system recording head 5. In this case, ink wiping device 12 is arranged in the direction of printer main body 12 so that the direction of nozzles which forms a head is parallel to the longitudinal direction of ink absorber 15.

Figure 8:
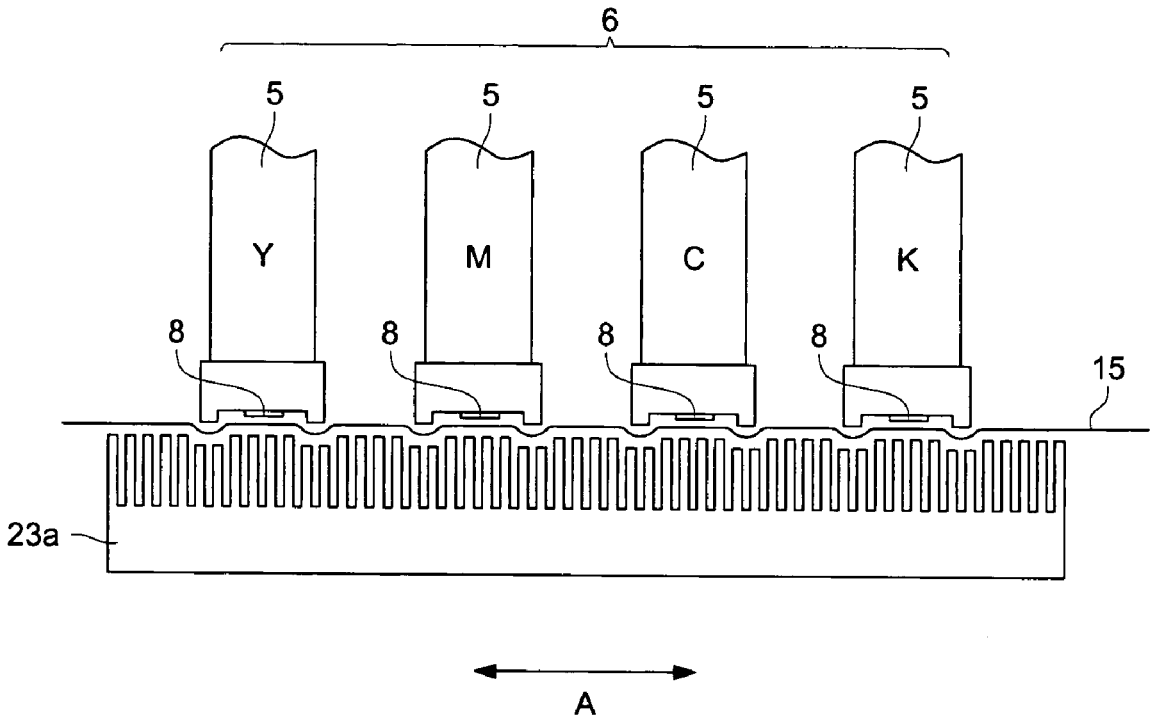
FIG. 8 is a front view showing a part of the ink-wiping device in the case where a slit is brought into pieces, when the pressing member brings the ink absorber into contact with the nozzle surface.

Further, in the present embodiment, the slit 21 of pressing member 23*a* is formed so that it corresponds to the interval of convex portion 28 of recording head. However, as shown in FIG. 8, it is also possible that when the slit 21 is further thinned, while ink absorber 15 is structured to flexibly correspond to the convex portion 28 of recording head 5, pressing member 23*a* is moved also to other than the direction of the row of nozzles (in the present embodiment, the main scanning direction A or the direction obliquely crossing to ink absorber 15) and the ink is absorbed in ink absorber 15.

Further, in the present embodiment, the support table drive device is provided and pressing member 23*a* is reciprocally moved so that ink absorber absorbs ink. However, it is possible that ink may also be absorbed in ink absorber 15 without the support table drive device by always operating the ink absorber driving device while moving pressing member 23*a* being in contact with the rear surface of ink absorber 15 when the winding-up movement of ink absorber 15 is moved.

EXAMPLE 2

Next, example 2 of the present invention will be described. For parts of the same structure and function as Example 1 in the example, the description will be omitted herein.

Figure 9:
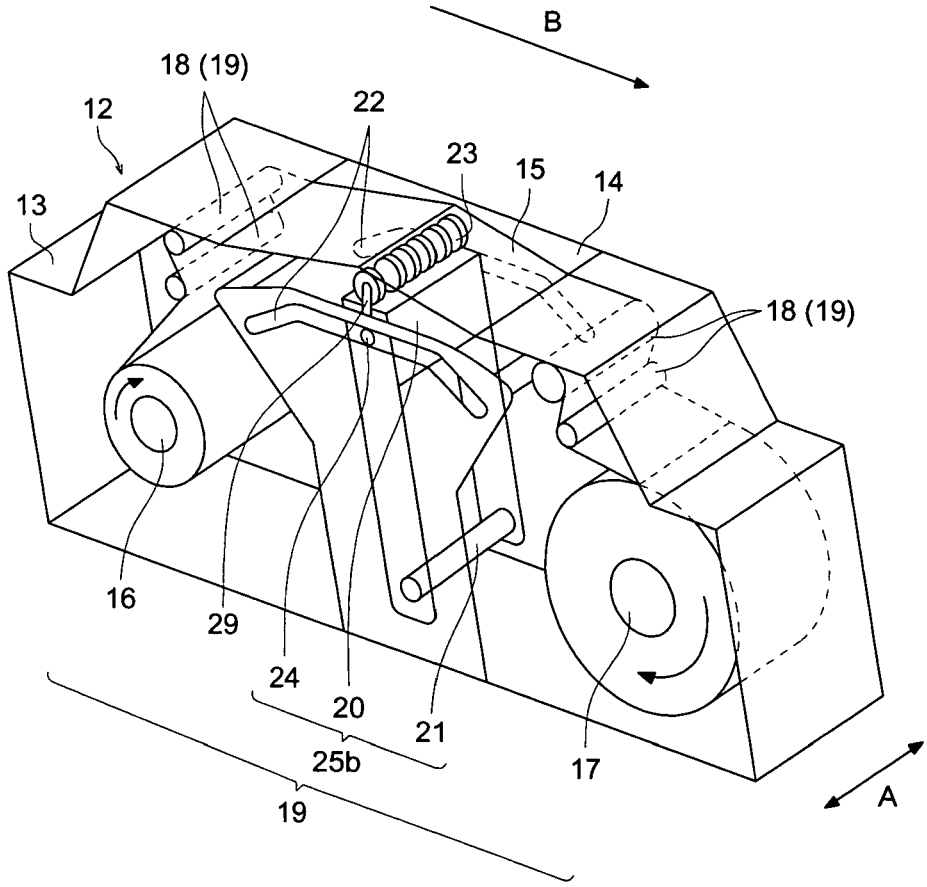
FIG. 9 is a perspective view of the ink-wiping device in the inkjet printer shown in FIG. 1.
Figure 10:
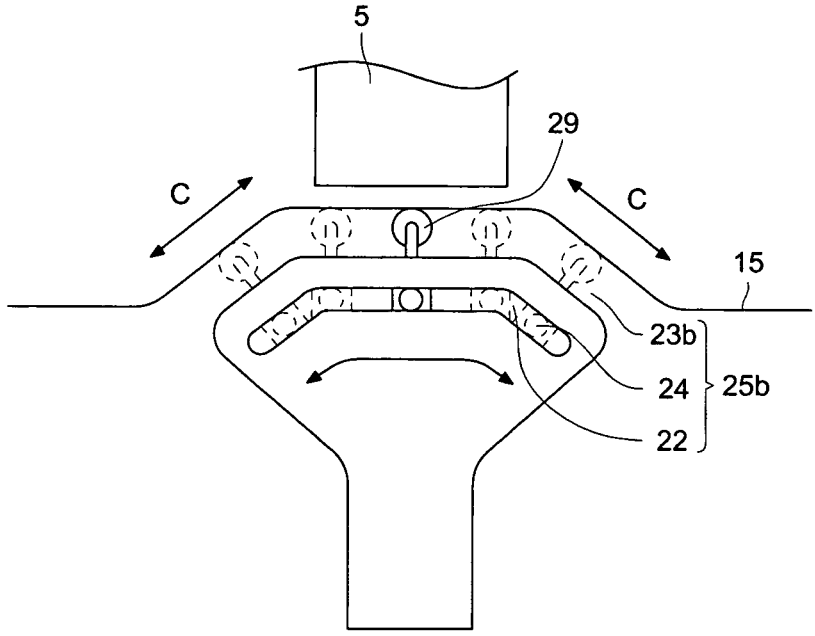
FIG. 10 is a front view showing a part of the ink-wiping device expressing the operation of the pressing member.

To the upper end portion of the support table 20, as shown in FIG. 9, a pressing member 23*b* is movably affixed upward and downward, and the pressing member 23*b* has the support shaft 30 extending along the width direction of the support table 20. In the outer periphery of support shaft 30, a contact portion 32 being a long thin board formed in a spiral shape is arranged. And a spiral slit 31 is formed between this contact portions 32. This contact portion 32 is fixed to both end portions of the support shaft 30, and the contact portion 32 is held with a predetermined interval to the outer peripheral surface of the support shaft 30.

The support shaft 30 of the pressing member 23*b* is rotatably supported by a pair of support strips 29 arranged on both sides of the upper end portion of the support table 20. Guide shafts 24 engaged with a guide hole 22 are affixed to the both sides of the pressing member 23*b*. Then, when the support table 20 is oscillatory-operated by the support table drive device (not shown) the pressing member 23*b* is vibrated and guide shaft 24 of the pressing member 23*b* is guided to the guide hole 22, while the pressing member 23*b* is moved upward and downward together with the support strip 32 relative to the support table 20 as being rotated. It is moved along the sub scanning direction B on the rear surface of ink absorber 15. Hereupon, in the present embodiment, the support table movement device 25*b* is structured by the support table 20, support shaft 21, guide hole 22, guide shaft 24 and support table drive device.

As shown in FIG. 11, on both side edges of nozzle surface 9 of recording head 5 of the present embodiment, convex portions 28 for protecting nozzle 8 are formed. In the present embodiment, the width dimension of the slit 31 of the pressing member 23*b* is formed so as to be a range of 1.0–5.0 mm. Then, when the pressing member 23*b* is brought into contact with nozzle surface 9 of recording head 5 through ink absorber 15, the pressing member 23*b* is rotated following the oscillation movement of the support table 20, and the position of the slit 31 in the axis direction of the pressing member 23*b* and the contact portion 32 can be moved. Hereby, the contact portion 32 can be assuredly brought into contact with nozzle surface 9 of recording head 5.

As described above, when the pressing member 23*b* which is a spiral member, is rotated while it is brought into close contact with nozzle surface 9 through ink absorber 15. Even when the viscosity of the ink is high and wettability is poor, the ink of nozzle surface 9 is absorbed by ink absorber 15, and the ink adhered to the vicinity of nozzle 8 can be assuredly removed and the wiping function of recording head 5 can be assuredly conducted. As a result, the very fine image can be obtained without affecting bad influence due to the ink adhered on nozzle surface 9 of recording head 5.

Further, since the pressing member 23*b* itself is rotated, the pressing member 23*b* can be flexibly brought into close contact with nozzle surface 9 corresponding to the concave and convex when a different recording head is mounted on carriage 4. Even when the stopping accuracy of recording head 5 is poor, the high grade control structure is not necessary and the ink adhered to nozzle surface 9 can be assuredly removed. As a result the ink fixedly adhered in the vicinity of nozzle 8 can be removed and clogging can be prevented. Consequently a cleaning operation can be effectively conducted and the very fine image can be obtained.

Hereupon, in the present embodiment, as shown in FIG. 11, a member into which a long thin board is spirally formed is used as the pressing member 23*b*. However, as shown in FIG. 12(*a*), the pressing member 23*b* in which slits oblique to a central shaft are formed on the surfaces opposing each other of the outer periphery of the thin wall cylindrical member also may be employed. Further, as shown in FIG. 12(*b*), the spiral pressing member 23*b* in which a narrow interval and a broad interval of the intervals of the slits 31 are alternately arranged may also be used. In this case, in addition to the above effects, as the concave and convex of ink absorber 15 is changed, it can correspond to various recording heads.

Further, in the present embodiment, the movement direction of the pressing member 23*b* is set in the sub scanning direction B being the direction of the nozzle row. However, it is also possible that, ink is absorbed in ink absorber 15 by moving the pressing member 23*b* in the other direction of the nozzle row (in the present embodiment, a direction obliquely crossing to the main scanning direction A or ink absorber 15).

EXAMPLE 3

Next, Example 3 of the present invention will be described. For parts of the same structure and function as Example 1, the description will be omitted herein.

Figure 13:
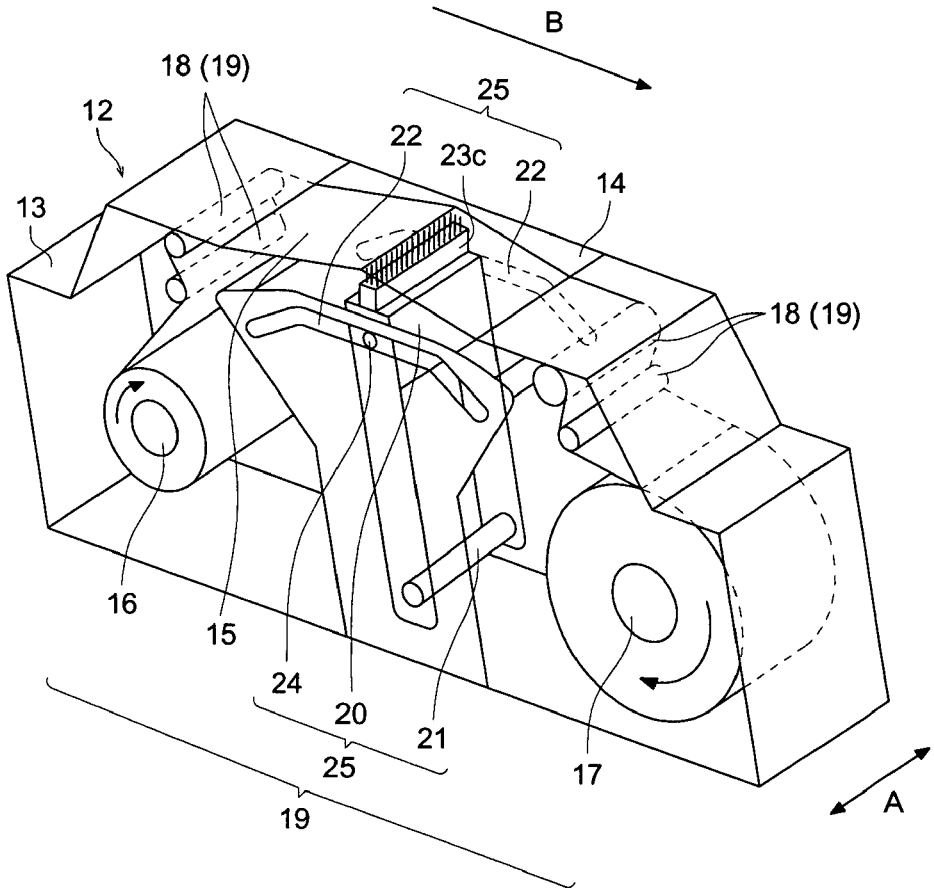
FIG. 13 is a perspective view of the ink-wiping device in the inkjet printer shown in FIG. 1.

As shown in FIG. 13, pressing member 23*c* is movably affixed upward and downward to the upper end portion of the support table 20 and guide shafts 24 which are engaged with the guide hole 22 are affixed in both sides of the pressing member 23*c*. Then, when the support table 20 is swung by the support table drive device (not shown), the pressing member 23*c* is vibrated following the swing-movement of the support table 20. Then guide shaft 24 of the pressing member 23*c* is guided to the guide hole 22 and pressing member 23*c* is moved on the rear surface of ink absorber 15 in the sub scanning direction B while moving upward and downward relative to support table 20. Hereupon, in the present embodiment, a support table moving device 25*c* is structured by support table 20, support shaft 21, guide hole 22, guide shaft 24 and support table drive device.

Figure 14:
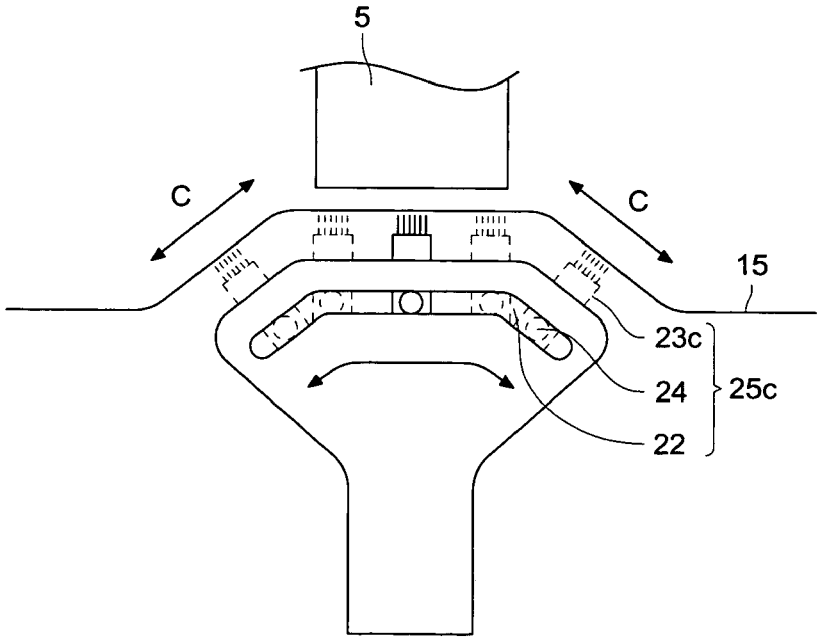
FIG. 14 is a front view showing a part of the ink-wiping device when a carriage is moved to the ink-wiping device shown in FIG. 2.
Figure 15:
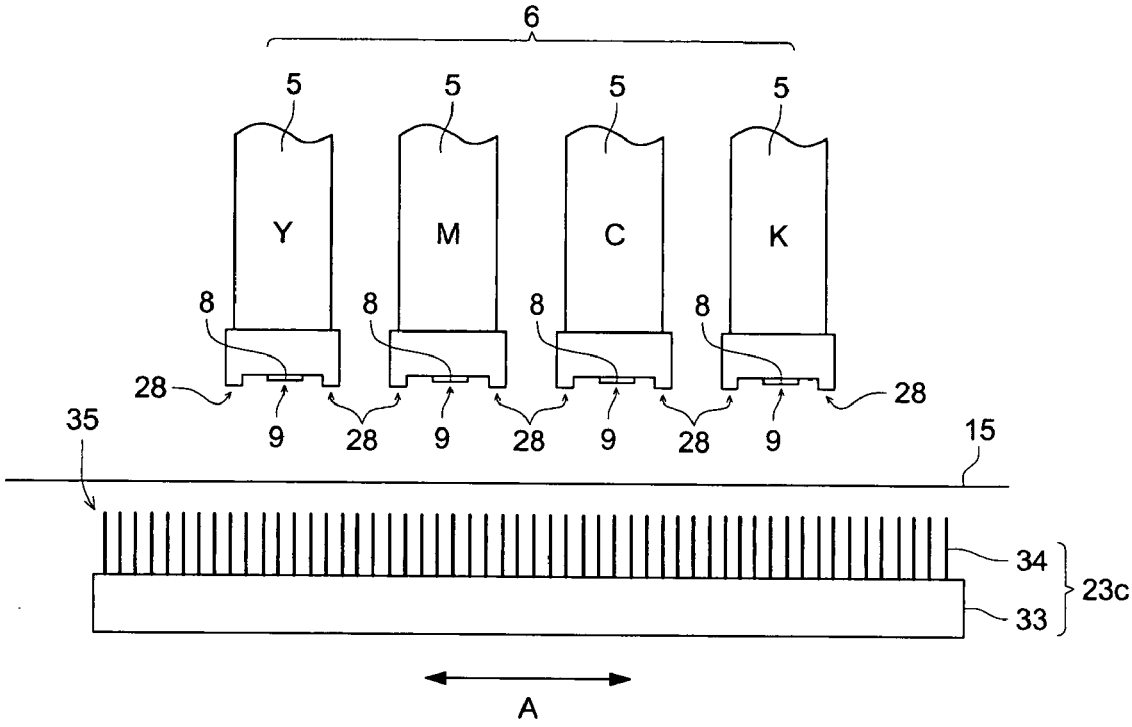
FIG. 15 is a front view showing a part of the ink-wiping device expressing an operation of the pressing member.
Figure 16:
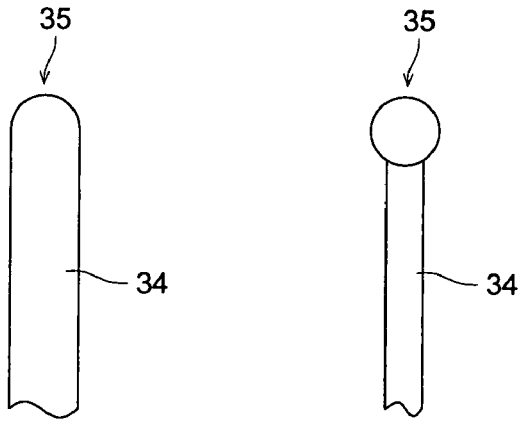
FIG. 16(*a*) is a perspective view of the pressing member in which a leading edge of a hair member is curved surface-shape, and FIG. 16(*b*) is a perspective view of the pressing member in which a leading edge of the hair member is spherical-shape.

In the present embodiment, as shown in FIGS. 13 and 14, the pressing member 23*c* is formed into a brush in which a plurality of hair members 34 is densely planted on the base table 33. The diameter of the cross section of the hair member 34 is not larger than 1 mm and an appropriate elastic effect is given to the hair member 34. Further, the leading edge of hair member 34 is formed in a shape of a curved surface or spherical surface as shown in FIGS. 16(*a*) and 16(*b*). This leading edge portion is a contact portion 35. Hereby, the contact portion 35 is arranged not to penetrate the contacted material or to damage it.

As shown in FIG. 14, convex portions 28 are formed on both side edges of nozzle surface 9 of recording head 5 of the present embodiment to protect nozzle 8. In the present embodiment, since pressing member 23*c* is formed by the hair member 34, the contact portion 35 has the elastic force, as a result, even when the contact portion 35 comes into contact with the convex portion 28 of recording head 5, the hair member 17 is deflected and the contact portion 35 corresponding to nozzle surface 9 can be adequately brought into contact with nozzle surface 9, and ink absorber 15 can be brought into close contact with nozzle surface 9. Hereupon, it is preferable many number of hair members are formed, since ink absorber 15 can be more easily brought into close contact with nozzle surface 9.

Hereupon, the width dimension of the pressing member 23*c* has a length, at least equal or more than the width dimension of ink absorber 15.

Since pressing member 23*c* has elasticity, the force more than a required force is not given to nozzle surface 9, and the damage of nozzle 8 or nozzle surface 9 can be prevented.

In this case, since leading edge of the brush 34 is a spherical surface, it does not penetrate ink absorber 15, and does not damage nozzle 8 or recording head 5.

Further, by forming the pressing member itself into brush, when the different recording head 5 is positioned on carriage 4, the pressing member 23*c* is flexibly brought into close contact with it corresponding to the concave and convex. Even when the stop accuracy of recording head 5 is poor, a high grade control structure is not necessary, and the ink adhered to nozzle surface 9 can be assuredly removed. As a result the ink fixedly adhered in the vicinity of nozzle 8 can be removed and clogging can be prevented. Consequently a cleaning operation can be effectively conducted and the very fine image can be obtained.

Figure 17:
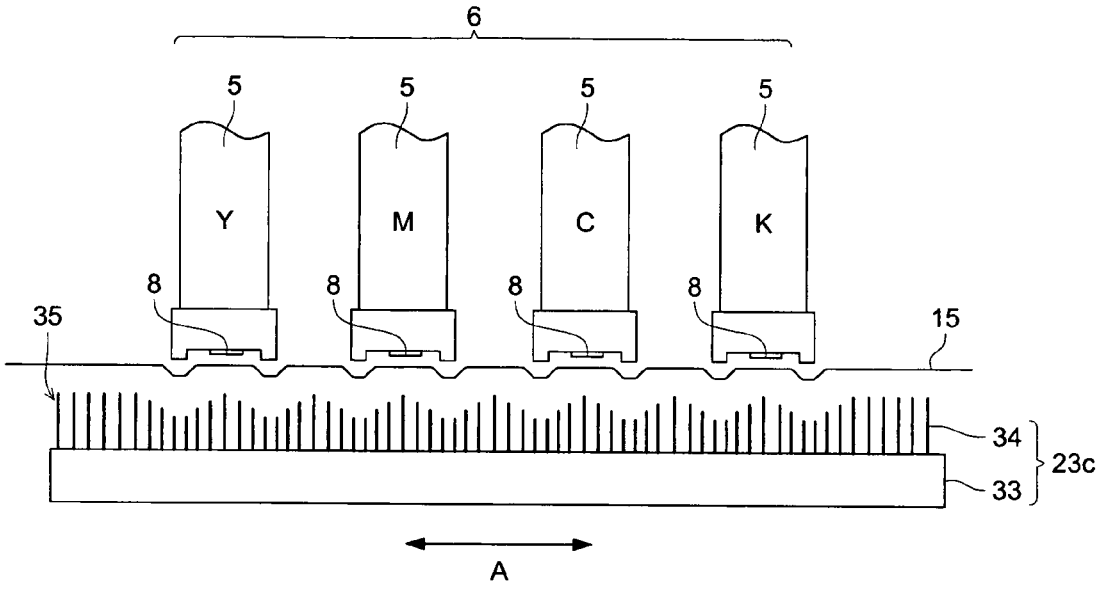
FIG. 17 is a front view showing a part of an ink-wiping device when the pressing member brings the ink absorber into contact with a nozzle surface.
Figure 18:
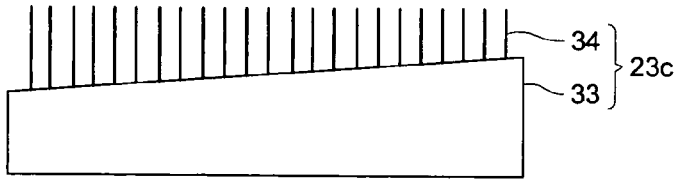
FIG. 18(*a*) is a front view of a pressing member 23 composed of an inclined base 26, and FIG. 18(*b*) is a front view of the pressing member 23 composed of a V-shaped base 26 whose thickness of the central part is thinner than the both ends.
Figure 18:
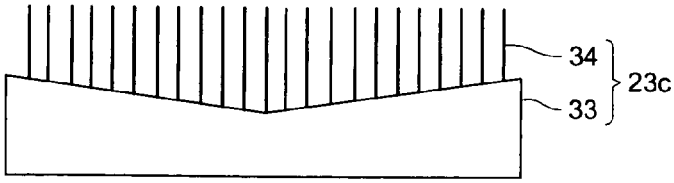

Further, in the present embodiment, base table 33 is employed for pressing member 23*c* as shown in FIG. 17. However, it may also be applicable that, as shown in FIG. 18(*a*), when an inclination is formed in such a manner that one end of the base table 33 is thinner than the other end, and the length of the hair member is adjusted, pressing member 23 is formed so that the thickness of pressing member 23*c* is equal as a whole or as shown in FIG. 18(*b*), a pressing member 23 formed in such a manner that the inclination is formed into V-shape so that the thickness of the central portion of the base table 33 is thinner than both ends, may also be used. In such manner, when base table 33 of pressing member 23*c* has the inclination, even when the ink drops on the base table 33 in a rare possibility, it is also possible to form the structure which can easily discharge it.

Figure 19:
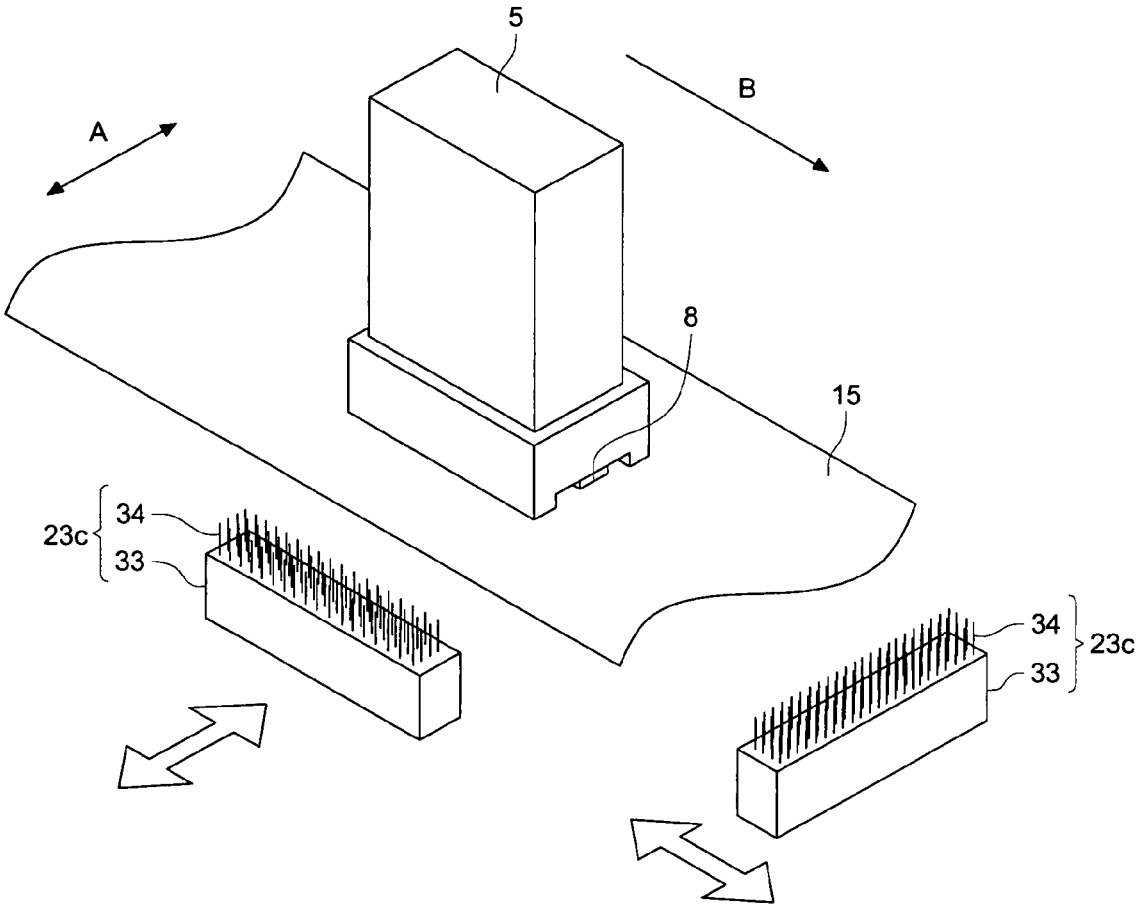
FIG. 19 is a perspective view of the ink-wiping device expressing a movement direction of the pressing member to the ink absorber.

Further, in the present embodiment, the movement direction of the pressing member 23*c* is set in the sub scanning direction B which is a direction in which the nozzle row is formed. However, as shown in FIG. 19, it is also possible that, ink is absorbed in ink absorber 15 by moving the pressing member 23*c* in the other direction of the nozzle row (in the present embodiment, a direction obliquely crossing to the main scanning direction A or ink absorber 15).

According to the present invention, since the pressing member can appropriately have elastic force, comparing with one in which the slit is not provided, while the pressing member is assuredly brought into close contact with the ink absorber, ink of the nozzle surface is assuredly absorbed in the ink absorber. Consequently, ink adhered in the vicinity of a nozzle can be assuredly removed. So ink is not fixedly adhered in the vicinity of the nozzle and clogging can be prevented. As a result an effective cleaning operation can be conducted and a very fine image can be obtained.

According to the present invention, since a pressing member can move along the nozzle surface, while moving along the nozzle surface, it can bring an ink absorber into contact with the nozzle surface.

Further, because it can appropriately have an elastic force, and deflect an arc board member, the pressing member can be pressed onto the ink absorber without damaging it.

According to the present invention, since when the pressing member is brought into contact with the nozzle, the ink absorber can be brought into close contact with the nozzle surface, ink adhered to the nozzle is assuredly absorbed in the ink absorber, and the ink adhered to the nozzle surface can be assuredly removed.

Further, because the pressing member can be used for a long period of time without being swelled and resolved by adhesion of ink including an organic solvent such as, for example, cation series ultraviolet ray hardening ink, it is not necessary that the pressing member is frequently replaced, the trouble of the replace operation can be saved, and the very fine image can be obtained for a long period of time by a low cost structure.

Further, even when ink whose viscosity is high and wettability is poor, since the ink absorber can be assuredly brought into close contact with the nozzle, and the ink can be absorbed. Even when the ink whose viscosity is high and the wettability is poor such as, for example, ultraviolet ray hardening ink is used, a very fine image can be obtained.

According to the present invention, since new ink absorber which is a part in which the ink is not absorbed, can be brought into contact with it without being replaced, it is not necessary that the ink absorber is frequently replaced. As a result the trouble associated with a replace operation can be removed and the very fine image can be obtained for a long period of time by a low cost structure.

Further, according to the present invention, since ink can be effectively hardened by irradiating the ultraviolet ray, irrespective of the recording medium, even in the recording medium such as the resin film whose ink absorptivity is poor, when it is combined with the current invention, a vary fine image can be obtained.

What is claimed is:

1. An inkjet printer comprising:

a recording head having a plurality of nozzles for jetting ink; and an ink wiping device for wiping ink adhered on a surface of a nozzle of the plurality of nozzles, the ink wiping device including:

an ink absorber for absorbing ink, a moving device for moving the ink absorber, and a pressing member to press a surface of the ink absorber toward the surface of the plurality of nozzles, wherein the pressing member moves along the surface of the plurality of nozzles, and wherein the pressing member is structured by a curved thin board member having a plurality of slits shaped in an arc in a cross section in a moving direction of the ink absorber.

2. The inkjet printer of claim 1, wherein the curved thin board member has a thickness being equal to or more than 0.2 mm and equal to or less than 2.0 mm.

3. The inkjet printer of claim 1, wherein the plurality of nozzles has a nozzle surface formed in a concave shape and a convex shape and the plurality of slits is provided corresponding to the position of the concave shape and the convex shape of the pressing member.

4. The inkjet printer of claim 1, wherein the pressing member is formed by polypropylene, polyethylene, 4-ethylene fluoride, or 4, 6-ethylene fluoride.

5. The inkjet printer of claim 1, wherein the ink absorber is a high density fiber woven by 0.1 denier fineness fiber formed by a material being selected from polypropylene, acryl and nylon, or one of any combination of polypropylene, acryl and nylon.

6. The inkjet printer of claim 1, wherein the ink absorber is formed in a sheet shape and one end of the ink absorber is wound around a supply shaft from which the ink absorber is supplied and another end of the ink absorber is wound around a winding-up shaft for taking up the ink absorber.

7. The inkjet printer of claim 1, wherein the ink has a viscosity coefficient of 10–50 [mPa·s] at 23° C. and a surface tension of 20–40 [mN/m].

8. The inkjet printer of claim 1, wherein the ink includes an activation energy ray hardening compound and the activation energy is ultraviolet rays.

9. An inkjet printer comprising:

a recording head having a plurality of nozzles for jetting ink; and an ink wiping device for wiping ink adhered on a surface of a nozzle of the plurality of nozzles, the ink wiping device including:

an ink absorber for absorbing ink, a moving device for moving the ink absorber, and a pressing member to press a surface of the ink absorber toward the surface of the plurality of nozzles, where the pressing member moves alone the surface of the plurality of nozzles, and wherein the pressing member is spirally formed by a long thin board wound around a shaft and both ends of the long thin board are fixed on the shaft.

10. The inkjet printer of claim 9, wherein the long thin board has a spiral slit and a pitch of the spiral slit being equal to or more than 1 mm and equal to or less than 5 mm.

11. The inkjet printer of claim 9, wherein the pressing member is formed by polypropylene, polyethylene, 4-ethylene fluoride, or 4, 6-ethylene fluoride.

12. The inkjet printer of claim 9, wherein the ink absorber is a high density fiber woven by 0.1 denier fineness fiber formed by a material being selected from polypropylene, acryl and nylon, or one of any combination of polypropylene, acryl and nylon.

13. The inkjet printer of claim 9, wherein the ink absorber is formed in a sheet shape and one end of the ink absorber is wound around a supply shaft from which the ink absorber is supplied and another end of the ink absorber is wound around a winding-up shaft for taking up the ink absorber.

14. The inkjet printer of claim 9, wherein the ink has a viscosity coefficient of 10–50 [mPa·s] at 23° C. and a surface tension of 20–40 [mN/m].

15. The inkjet printer of claim 9, wherein the ink includes an activation energy ray hardening compound and the activation energy is ultraviolet rays.

16. An inkjet printer comprising:

a recording head having a plurality of nozzles for jetting ink; and an ink wiping device for wiping ink adhered on a surface of a nozzle of the plurality of nozzles, the ink wining device including:

an ink absorber for absorbing ink, a moving device for moving the ink absorber, and a pressing member to press a surface of the ink absorber toward the surface of the plurality of nozzles, wherein the pressing member moves along the surface of the plurality of nozzles, and wherein the pressing member comprises a base unit and a plurality of hair members formed into a brush shape planted on the base unit.

17. The inkjet printer of claim 16, wherein the plurality of hair members has a diameter being equal to or less than 1 mm and an edge of a hair member of the plurality of hair members is formed in a curved shape or a spherical surface shape.

18. The inkjet printer of claim 16, wherein the pressing member is formed by polypropylene, polyethylene, 4-ethylene fluoride or 4, 6-ethylene fluoride.

19. The inkjet printer of claim 16, wherein the ink absorber is a high density fiber woven by 0.1 denier fineness fiber formed by a material being selected from polypropylene, acryl and nylon, or one of any combination of polypropylene, acryl and nylon.

20. The inkjet printer of claim 16, wherein the ink absorber is formed in a sheet shape and one end of the ink absorber is wound around a supply shaft from which the ink absorber is supplied and another end of the ink absorber is wound around a winding-up shaft for taking up the ink absorber.

21. The inkjet printer of claim 16, wherein the ink has a viscosity coefficient of 10–50 [mPa·s] at 23° C. and surface tension of 20–40 [mN/m].

22. The inkjet printer of claim 16, wherein the ink includes an activation energy ray hardening compound and the activation energy is ultraviolet rays.

23. The inkjet printer of claim 16, wherein the pressing member is formed by polypropylene, polyethylene, 4-ethylene fluoride, or 4, 6-ethylene fluoride.

* * * * *